US011408264B2

(12) United States Patent
Yu et al.

(10) Patent No.: US 11,408,264 B2
(45) Date of Patent: Aug. 9, 2022

(54) VOLUMETRIC FRACTURING METHOD OF TEMPORARILY PLUGGING AND DIVERTING THROUGH FUNCTIONAL SLICK WATER WITH OIL DISPLACEMENT AGENT INJECTED SIMULTANEOUSLY

(71) Applicants: YANGTZE UNIVERSITY, Jingzhou (CN); Jingzhou Modern Petroleum Technology Development Co. LTD, Jingzhou (CN)

(72) Inventors: Weichu Yu, Jingzhou (CN); Ying Zhang, Jingzhou (CN); Rui Li, Jingzhou (CN); Hui Zhao, Wuhan (CN); Lei Zhang, Wuhan (CN); Wenjie Xia, Tianjin (CN); Pingtian Fan, Yanan (CN); Baocheng Wu, Karamay (CN); Wenming Shu, Jingzhou (CN); Fei Ding, Qingdao (CN)

(73) Assignees: YANGTZE UNIVERSITY, Jingzhou (CN); JINGZHOU MODERN PETROLEUM TECHNOLOGY DEVELOPMENT CO. LTD, Jingzhou (CN)

( * ) Notice: Subject to any disclaimer, the term of this patent is extended or adjusted under 35 U.S.C. 154(b) by 56 days.

(21) Appl. No.: 16/952,704

(22) Filed: Nov. 19, 2020

(65) Prior Publication Data

US 2022/0127942 A1 Apr. 28, 2022

(30) Foreign Application Priority Data

Oct. 23, 2020 (CN) ..... 202011143302.6

(51) Int. Cl.
*E21B 43/20* (2006.01)
*E21B 33/138* (2006.01)
(Continued)

(52) U.S. Cl.
CPC ..... *E21B 43/267* (2013.01); *E21B 33/138* (2013.01); *E21B 49/00* (2013.01)

(58) Field of Classification Search
CPC ..... E21B 33/138; E21B 49/00; E21B 43/26; E21B 43/267; E21B 43/20; C09K 8/58
See application file for complete search history.

(56) References Cited

U.S. PATENT DOCUMENTS 3,818,990 A * 6/1974 Coulter ..... E21B 43/267 166/280.1
4,157,116 A * 6/1979 Coulter ..... E21B 33/138 166/280.1

(Continued)

*Primary Examiner* — Kenneth L Thompson
(74) *Attorney, Agent, or Firm* — WPAT, PC

(57) ABSTRACT

Disclosed is a method for determining three-dimensional in-situ stress based on displacement measurement of borehole wall, including the following steps: pumping the prefluid and the sand-carrying fluid into the target interval, and injecting the biological oil displacement agent into the target interval in sequence; pumping temporary plugging agent into the target layer to implement crack plugging diverting; pumping the sand-carrying liquid into the target interval, and injecting the biological oil displacement agent into the target interval. The beneficial effect of the technical scheme proposed in this disclosure is: by injecting oil displacement agent to fracturing fluid, the temporary plugging diverting fracturing is integrated constructed with enhanced oil recovery, at the same time, it can overcome the incomplete removal of temporary plugging agent and the water lock effect of fracturing fluid caused by diverting fracturing.

10 Claims, 3 Drawing Sheets

(51) Int. Cl.
*E21B 43/267* (2006.01)
*E21B 49/00* (2006.01)

(56) References Cited

U.S. PATENT DOCUMENTS

| | | | | |
|---|---|---|---|---|
| 7,380,600 | B2 * | 6/2008 | Willberg | C09K 8/80 507/260 |
| 10,161,235 | B2 * | 12/2018 | Green | E21B 43/26 |
| 10,954,767 | B2 * | 3/2021 | Dahi Taleghani | E21B 43/26 |
| 11,047,232 | B2 * | 6/2021 | Knight | G16B 40/00 |
| 11,111,766 | B2 * | 9/2021 | Brannon | E21B 43/267 |
| 2017/0350222 | A1 * | 12/2017 | Gullickson | C09K 8/62 |
| 2021/0108495 | A1 * | 4/2021 | Yu | E21B 43/26 |
| 2021/0148221 | A1 * | 5/2021 | Dusterhoft | E21B 43/26 |
| 2021/0230475 | A1 * | 7/2021 | Mazrooee | C09K 8/685 |

* cited by examiner

VOLUMETRIC FRACTURING METHOD OF TEMPORARILY PLUGGING AND DIVERTING THROUGH FUNCTIONAL SLICK WATER WITH OIL DISPLACEMENT AGENT INJECTED SIMULTANEOUSLY

FIELD OF THE DISCLOSURE

The disclosure relates to volumetric fracturing method of temporarily plugging and diverting through functional slick water with oil displacement agent injected simultaneously.

BACKGROUND

Low-permeability oil and gas reservoirs have complex geological conditions and poor stimulation and improvement effects. At present, low-permeability oil and gas reservoirs are developed through horizontal well drilling and hydraulic fracturing technologies to increase the contact area between fractures and reservoirs to develop low permeability reservoirs economically and efficiently. In order to improve the fracturing effect of low-permeability reservoirs, more advanced technologies are required to cooperate with hydraulic fracturing to further improve oil and gas recovery. Technical means such as multi-fracture staged fracturing, fracturing and integration of enhanced oil recovery has become the focus of exploration and development worldwide. Whether it is conventional vertical well reconstruction fracturing or multi-fracture staged fracturing in unconventional horizontal well sections, temporary plugging agents are used for fracturing diverting, so that the new fractures generated by fracturing fluids are different from the previous artificial or natural fractures. The newly opened fractures are redirected to unreformed areas or areas that are not fully reformed, so as to establish new oil and gas seepage channels and change the rule of oil and gas reservoir fluid seepage and displacement, and obtain the effective reformed volume of single well to improve the effect of low permeability reservoirs stimulation.

The conventional enhanced oil recovery technologies include: chemical flooding, gas flooding, thermal flooding, microbial flooding, molecular film flooding, etc. The microbial flooding enhanced oil recovery technology has the advantages of low cost, convenient construction, wide application range, no damage to the formation and construction equipment, no pollution to the environment and so on. The conventional microbial enhanced oil recovery construction methods mainly include: single well huff and puff, microbial water flooding, microbial cycle flooding, microbial water fracturing, and microbial and other oil recovery measures, such as polymer flooding, ternary combined flooding, surfactants, etc.

At present, diverting fracturing and enhanced oil recovery are carried out separately as two constructions to improve oil recovery. Generally, diverting fracturing is implemented first, followed by enhanced oil recovery. The construction period is long, the input process is complicated with material wasted and environmental pollution. Situations such as incomplete removal of temporary plugging agent and water locking effect of fracturing fluid caused by diverting fracturing will affect the depth and breadth of subsequent bio-displacement agent injection, affect the oil displacement effect, and reduce the recovery of enhanced oil recovery in the reservoir. At the same time, fractures generated by diverting fracturing which uses high-sand ratio fracturing fluids are less complex than conventional hydraulic fracturing, and the affected volume is small. The volume of connected oil and gas reservoirs is limited, which lead to the problems such as low initial production after fracturing, rapid production decline, and short stable production period and so on.

SUMMARY

A technical problem to be solved by the disclosure is to provide a fracturing method that can improve construction efficiency, enhance the injection depth and breadth of biological oil displacement agent, enhance oil displacement effect, increase the recovery rate of enhanced oil recovery, and increase the production of single well.

A volumetric fracturing method of temporarily plugging and diverting through functional slick water with oil displacement agent injected simultaneously includes the following steps:

S1 obtaining the reservoir parameters of the target interval of an implementation well to determine the target interval for temporary plugging and steering fracturing, fracturing parameters, and pumping and injection construction procedures, wherein the fracturing parameters include at least flow rate, and the flow rate is not less than 6 $m^3$/min;

S2 in accordance with the pumping and injection construction procedures, pumping the prefluid and the sand-carrying fluid into the target interval in sequence, and at the same time, injecting the biological oil displacement agent into the target interval;

S3 pumping temporary plugging agent into the target layer according to the pumping and injection construction procedures to implement crack plugging diverting;

S4 pumping the sand-carrying liquid into the target interval in accordance with the pumping and injection construction procedures, and at the same time injecting the biological oil displacement agent into the target interval, wherein the sand ratio of the sand-carrying liquid is not more than 15%;

S5 pumping displacement fluid into the target interval in accordance with the pumping and injection construction procedures to complete the fracturing construction.

The beneficial effect of the technical scheme proposed in this disclosure is: by injecting oil displacement agent to reservoir, the temporary plugging diverting fracturing is integrated with enhanced oil recovery, which not only improves the injection depth and breadth of biological oil displacement agent, communicates remaining oil areas, and realizes the effect of enhanced oil recovery and improve the single well production, as well as reduces the construction risk of diverting fracturing, reduces construction investment, and improves construction efficiency. At the same time, it can overcome the incomplete removal of temporary plugging agent and the water lock effect of fracturing fluid caused by diverting fracturing. Meanwhile, through the use of high flow rate, low sand ratio fracturing, the complexity of the fracture network can be greatly increased, the sweep volume of the fractures can be increased, and the diverting fracturing effect can be improved.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Embodiment is provided below to further explain the method provided by this disclosure.

Figure 1:
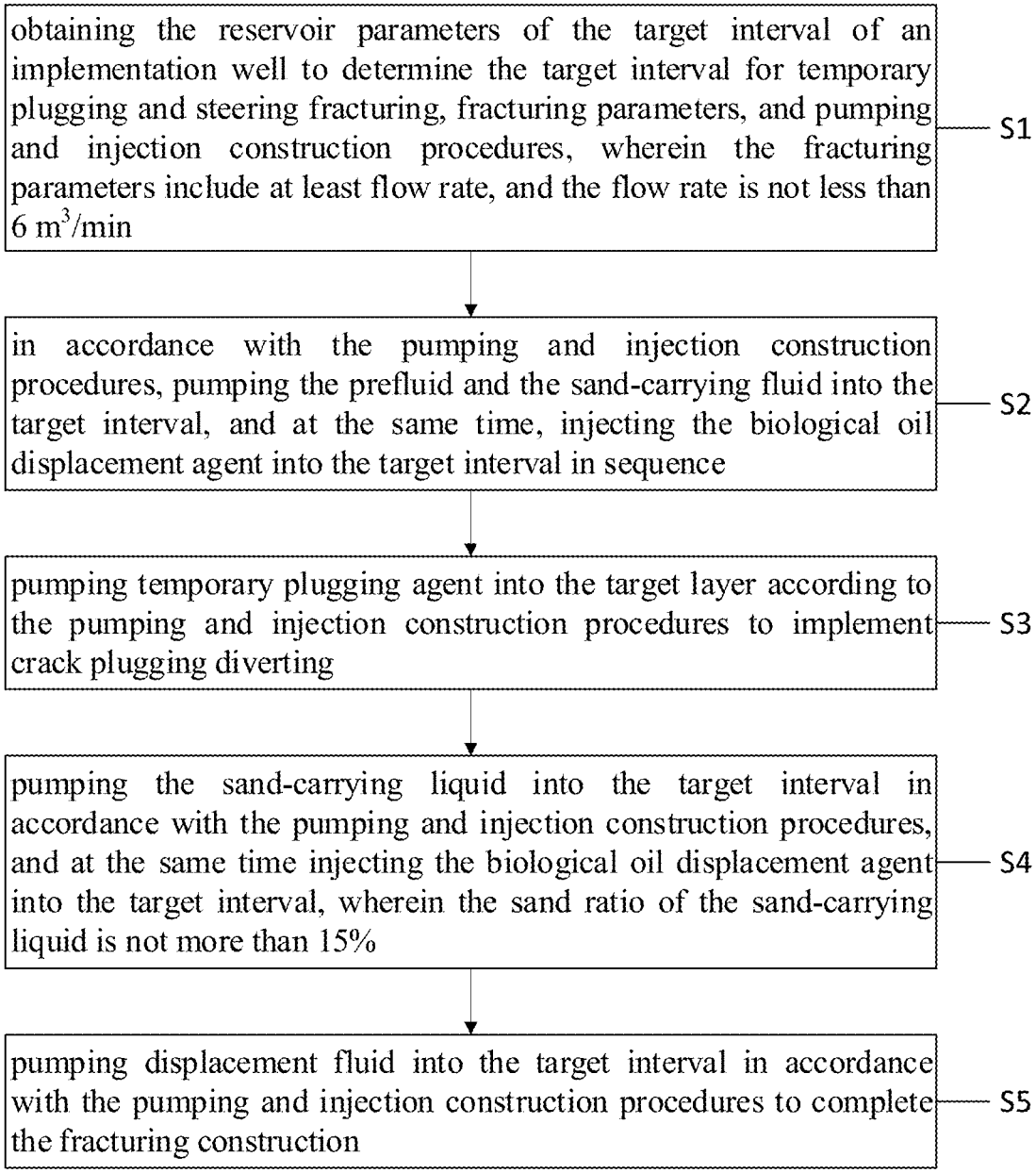
FIG. 1 is a schematic flow diagram of an embodiment of volumetric fracturing method of temporarily plugging and diverting through functional slick water with oil displacement agent injected simultaneously.

In order to verify the feasibility of this disclosure, an evaluation well in the Baiyinchagan Sag of the Ordos Basin was selected as the implementation well. The fracturing design and construction of this implementation well are designed and constructed using volumetric fracturing method of temporarily plugging and diverting through functional slick water with oil displacement agent injected simultaneously provided by this disclosure. As revealed in FIG. 1, the volumetric fracturing method of temporarily plugging and diverting through functional slick water with oil displacement agent injected simultaneously includes the following steps:

S1 obtaining the reservoir parameters of the target interval of an implementation well to determine the target interval for temporary plugging and steering fracturing, fracturing parameters, and pumping and injection construction procedures, wherein the fracturing parameters include at least flow rate, and the flow rate is not less than 6 $m^3$/min, which has a larger flow rate than conventional hydraulic fracturing, so as to improve the fracturing effect of the fracturing fluid;

The target interval where temporary plugging and fracturing can be implemented is mainly determined according to the re-construction conditions, the mining margin and the output cost.

The pump injection construction program usually requires the use of fracturing design software. In this embodiment, the fracturing design software is Fracpro PT, and the pump injection program table is set according to a large liquid volume, high flow rate, low sand ratio, slick water volumetric fracturing method.

S2 in accordance with the pumping and injection construction procedures, pumping the prefluid and the sand-carrying fluid into the target interval, and at the same time, injecting the biological oil displacement agent into the target interval in sequence, wherein the injection volume of the prefluid accounts for 30% to 50% of the total injection volume of the fracturing fluid, which has a larger proportion of the prefluid compared with conventional hydraulic fracturing to improve the fracturing fluid fracture-making ability;

S3 pumping temporary plugging agent into the target layer according to the pumping and injection construction procedures to implement crack plugging diverting;

S4 pumping the sand-carrying liquid into the target interval in accordance with the pumping and injection construction procedures, and at the same time injecting the biological oil displacement agent into the target interval, wherein the sand ratio of the sand-carrying liquid is not more than 15%;

S5 pumping displacement fluid into the target interval in accordance with the pumping and injection construction procedures to complete the fracturing construction.

S6 closing borehole on the implementation wells. In a preferred embodiment, the boreholes closing time lasts for 15-20 days. After that, the routine operations are completed by measuring the pressure drop, controlling the blowout, thoroughly backwashing the well, pulling out the fracturing string, and exploring the sand surface of the tubing, which will not be repeated here.

The principle of the volumetric fracturing method of temporarily plugging and diverting through functional slick water with oil displacement agent injected simultaneously provided by this disclosure is as follows: by adopting large liquid volume, high flow rate, large prefluid, low sand ratio, low viscosity, intermittent columnar stepped sanding process and injection of biological oil displacement agent, and using high-efficiency temporary plugging agent for fracturing diverting, namely the new concept and new technology of oil displacement agent slick water temporary plugging and diverting to volumetric fracturing simple on-site implementation and relatively low cost, not only compensates for pressure and fluid deficit caused by production, supplements formation energy in low-pressure layers, but also penetrates fracturing fluid to connect new reservoirs, effectively increasing the contact area between fracturing fluid and the reservoir and the volume of reservoir reconstruction, reducing the oil-water interfacial tension and crude oil viscosity, and achieving the purpose of temporary plugging and diverting to increase production.

Preferably, the prefluid is slick water fracturing fluid, and the slick water fracturing fluid is used to create fractures and slug the reservoir in the initial stage of fracturing.

Preferably, the sand carrying fluid is slick water fracturing fluid containing proppants.

Preferably, the displacement fluid is slick water fracturing fluid that does not contain proppants.

Preferably, the viscosity of the slick water fracturing fluid is 1.0-3.0 mPa·s.

Preferably, the biological oil displacement agent is HE-BIO biological oil displacement agent.

Preferably, the temporary plugging agent is MP-1 type water-soluble temporary plugging agent for fracturing.

The above-mentioned slick water fracturing fluid, HE-BIO biological oil displacement agent and MP-1 type water-soluble temporary plugging agent for fracturing are all patented products of Jingzhou Modern Petroleum Technology Development Co., Ltd.

In this example, the completion depth is 1635.0 m, the completion zone is in the Arshan Formation, the artificial bottom hole is 1615.5 m, the joint is 4.52 m, the maximum well deviation is 3.6°/148.5°1411.70 m, and the formation temperature is 49° C. (estimated). The formation pressure is 16 MPa (estimated), the porosity is 5.6%, the oil saturation is 2.8%, and the permeability is $0.16\times10^{-3}$ $um^2$. By comprehensive interpretation of the dry glutenite layer, the well's logging and logging data and related geological data of this well, and the evaluation and analysis of the stratum, it is believed that the foundation of this layer is poor, the effect after compaction is difficult to guarantee, and there is a great geological risk. The specific process plan is:

(1) Adopt the fracturing method of stratification sealing and combined layer fracturing;

(2) The use of large liquid volume, high flow rate, low sand ratio, and large prefluid temporary plugging and diverting to volumetric fracturing, which can not only increase the reconstruction volume, but also supplement the formation energy;

(3) Small particle size and variable particle size proppants are used to meet the filling and support of complex multi-stage fractures;

(4) Using 12% dilute hydrochloric acid to clear the perforation blockage, dredge the perforation holes, remove the pollution near the well, and reduce the hole resistance and rupture pressure;

(5) Adopting fracturing—temporary plugging and diverting—fracturing—closing—draining—oil production construction technology to achieve the best fracturing and oil displacement effect. The well is closed for 15 to 20 days after fracturing, which further improves the effect of fracturing.

In this example, a fractured well section of 1562.4 to 1585.0 m is selected as the target interval for temporary plugging and diverting fracturing. Specifically, hydraulic sandblasting perforation with the same diameter is used, and the perforation effectively penetrates the casing and cement ring of the formation, the perforation penetration depth reaches more than 400 mm, and the perforation avoids the casing coupling.

Figure 2:
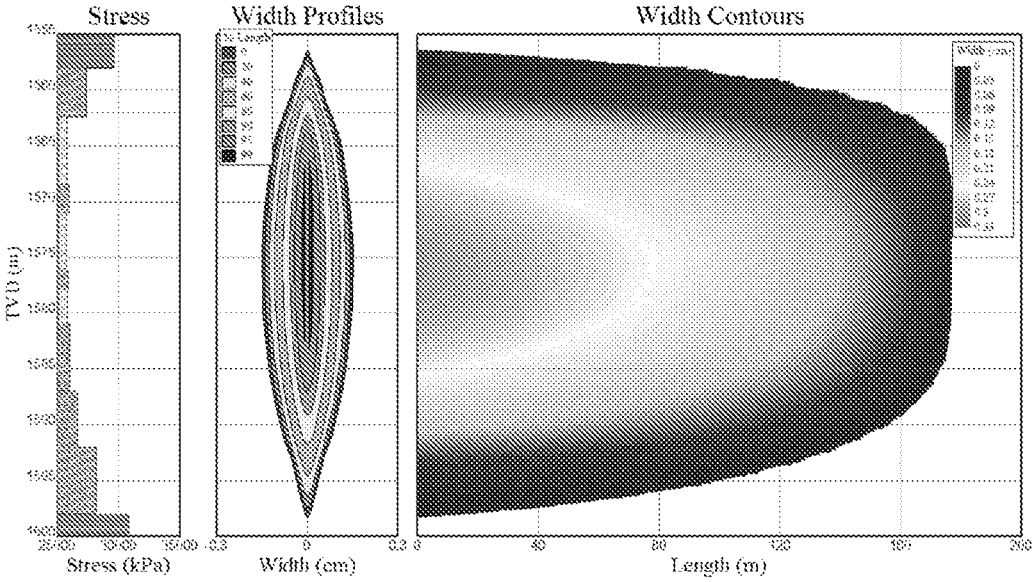
FIG. 2 is a fracture morphology diagram output by a preferred embodiment of volumetric fracturing method of temporarily plugging and diverting through functional slick water with oil displacement agent injected simultaneously.

In this example, the simulation parameter table of the fracturing design software Fracpro PT is shown in Table 1, the pump injection program table is shown in Table 2, and the fracture morphology simulated by the fracturing design software Fracpro PT is shown in FIG. 2:

TABLE 1

Software simulation fracture parameter table

| | | | |
|---|---|---|---|
| Designed seam length (m) | 175 | Flow rate ($m^3$/min) | 6 |
| Pre-fluid volume ($m^3$) | 13 | Total volume of prefluid ($m^3$) | 525 |
| Total volume of sand-carrying liquid ($m^3$) | 739 | Total volume of proppant ($m^3$) | 40.2 |
| Temporary plugging agent (20-120 mesh) (Kg) | 300 | Biological oil displacement agent ($m^3$) | 2.0 |
| Displacement fluid volume ($m^3$) | 40 | Average total crack height (m) | 15.1 |
| Maximum width of cracks at shaft wall (cm) | 0.68 | Crack height at the shaft wall (m) | 40.5 |

TABLE 2

Pumping and injection construction procedures table

| No. | Construction stage | Fluid name | Liquid volume ($m^3$) | Sand ratio (%) | Sand volume ($m^3$) | Proppant type | Oil displacement agent |
|---|---|---|---|---|---|---|---|
| 1 | Fill the shaft | Slick water | 5 | 0 | 0 | | |
| 2 | Squeeze acid to clear holes | 12% HCl | 8 | 0 | 0 | | |
| 3 | First stage of main fracturing | Pre-fluid | 365 | 2%-3% −4%-5% −6%-7% | 5.85 | 40/70 mesh quartz sand | 0.5% in the first 100 $m^3$ of the first stage |
| 4 | Second stage of main fracturing | Sand carrying liquid | 59 | 6%-7% −8% | 1.82 | 40/70 mesh quartz sand | |
| 5 | | | 62 | 7%-8% −9% | 2.09 | 40/70 mesh quartz sand | |
| 6 | | | 67 | 8%-9% −10% | 2.36 | 40/70 mesh quartz sand | |
| 7 | Third stage of main fracturing | | 67 | 6%-7% −8%-9% | 2.27 | 20/40 mesh quartz sand | |
| 8 | | | 65 | 7%-8% −9%-10% | 2.45 | 20/40 mesh quartz sand | 0.5% in the last 100 $m^3$ of the third stage |
| 9 | | | 63 | 8%-9% −10%-11% | 2.57 | 20/40 mesh quartz sand | |
| 10 | Temporarily plugging and diverting | Slick water | 5 | 0 | 0 | 20-120 mesh temporary plugging agent 300 Kg | |
| 11 | Fourth stage of main fracturing | Sand carrying liquid | 68 | 7%-9% −11%-13% | 2.62 | 20/40 mesh quartz sand | 0.5% in the first 100 $m^3$ of the fourth stage |

TABLE 2-continued

Pumping and injection construction procedures table

| Construction No. | stage | Fluid name | Liquid volume ($m^3$) | Sand ratio (%) | Sand volume ($m^3$) | Proppant type | Oil displacement agent |
|---|---|---|---|---|---|---|---|
| 12 | | | 72 | 8%-9% −10%-12% | 2.96 | 20/40 mesh quartz sand | |
| 13 | | | 77 | 9%-10% −11%-13% | 3.28 | 20/40 mesh quartz sand | |
| 14 | | | 87 | 10%-11% −12%-14% | 4.72 | 20/40 mesh quartz sand | 0.5% in the last 100 $m^3$ of the first stage |
| 15 | | | 52 | 12%-13% −14%-15% −16%-8% | 34.37 | 20/40 mesh quartz sand | |
| 16 | Displacement | Displacement liquid | 40 | 0 | 0 | | |
| 17 | Total | | 1317 | | 40.2 | | |

In this embodiment, as revealed in Table 2, step S2 is performed in three stages, and the specific steps include:

The first stage: injecting the prefluid into the target interval, after injecting 150-180 $m^3$ prefluid, beginning to alternately add 40/70 mesh quartz sand to slug, the sand ratio starts from 2% and increases by 1% sequentially to 7%. Preferably, the bio-oil displacement agent is injected at a rate of 0.5% at the same time as the first 100 $m^3$ of prefluid in the first stage is injected.

The second stage: alternately injecting the sand-carrying liquid into the target interval. The sand ratio of the sand-carrying liquid is increased in three steps in multiple injections, among which the quartz sand is 40/70 mesh. Preferably, the 40/70 mesh quartz sand is injected into the sand-carrying liquid for three times, in which the sand ratio of the sand-carrying liquid injected for the first time is increased in three steps of 6%-7%-8%; The sand ratio of the sand-carrying liquid increases in three steps of 7%-8%-9%; the sand ratio of the sand-carrying liquid injected for the third time increases in three steps of 8%-9%-10%.

The third stage: alternately injecting the sand-carrying liquid into the target interval. The sand ratio of the sand-carrying liquid is increased in four steps in multiple injections, among which the quartz sand is 20/40 mesh. Preferably, the 20/40 mesh quartz sand is injected into the sand-carrying liquid for three times, wherein the sand ratio of the sand-carrying liquid injected for the first time is increased in four steps of 6%-7%-8%-9%; the sand ratio of the sand-carrying liquid injected for the second time is increased in four steps of 7%-8%-9%-10%; the sand ratio of the sand-carrying liquid injected for the third time is increased in four steps of 8%-9%-10%-11%. In the third stage, the last 100 $m^3$ of the sand-carrying liquid was injected while the bio-displacement agent is injected at a rate of 0.5%.

Preferably, before step S2, the wellbore should be filled with 5 $m^3$ slick water fracturing fluid at a flow rate of 0.5 $m^3$/min, and then removed with 8 $m^3$12% dilute hydrochloric acid at a flow rate of 0.5-1 $m^3$/min to clear the perforation, the pollution near the well is removed, and the perforation resistance and rupture pressure are reduced.

The first stage of the step S2 is mainly to further expand the micro-fracture system that has been formed in the pre-fluid fracturing and add small particle size proppant (40/70 mesh quartz sand) to achieve as much as possible to various small-scale micro-fracture systems, as well as to eliminate the perforations and friction near the well, and communicate and saturate the natural fractures near the well. In the second and third stages, the high flow rate slick water fracturing fluid generates the net pressure required to meet the fracture half-length and the fracture width to continue to expand, completely open the main fractures of the remote well and connect the secondary fractures and the micro-natural, while in the third stage, large-size proppant (20/40 mesh quartz sand) is selected at the same time to support the gradually expanding fracture system.

In this embodiment, as revealed in Table 2. The specific steps of step S3 include: injecting 300 Kg of temporary plugging agent powder into the target interval, and the temporary plugging agent is directly injected into the sand mixing tank. Preferably, the temporary plugging agent adopts a 20-120 mesh MP-1 type water-soluble temporary plugging agent for fracturing, so as to realize the temporary plugging and turning in the fracture, create branch fractures and micro-fractures and pass through the inter-fracture interference of multiple fractures to further increase the fractures complexity.

In this embodiment, as revealed in Table 2, the specific steps of step S4 include: alternately injecting a sand-carrying liquid containing 20/40 mesh quartz sand into the target interval, and the sand ratio of the sand-carrying liquid is increased for four or six steps, and the injection is divided into multiple times.

Preferably, the sand ratio of the sand-carrying liquid injected for the first time is increased in four steps of 7%-9%-11%-13%; the sand ratio of the sand-carrying liquid injected for the second time is increased in four steps of 8%-9%-10%-12%; the sand ratio of the sand-carrying liquid injected for the third time is increased in four steps of 9%-10%-11%-13%, the sand ratio of the sand-carrying liquid injected for the fourth time is increased in four steps of 10%-11%-12%-14%, and the sand ratio of the sand-carrying liquid injected for the fifth time is increased in six steps of 12%-13%-14%-15%-16%-8% until all proppant injection is completed.

After the sand-carrying fluid injection is completed, 40 $m^3$ of displacement fluid is injected into the target interval to complete all the main fracturing operations.

Preferably, during the first 100 $m^3$ and the last 100 $m^3$ of the fourth stage, the bio-oil displacement agent is injected at a rate of 0.5% while the sand-carrying liquid is injected.

After completing the temporary plugging and diverting, continuing to use the large liquid volume and multi-step sand ratio alternate fracturing mode to continue to propagate the fractures after the diverting, and realize the support of the fractures and fractures, and finally form a complex network of volumetric fractures, so as to achieve larger reservoir reconstruction volume, while expanding the bio-displacement agent to all fractures, effectively reducing oil-water surface tension and crude oil viscosity, and has a good cleaning effect on oil sands. In the process of well closing, HE-BIO Biological oil displacement agents can generate carbon dioxide in situ in the oil reservoir to further improve the oil displacement effect.

Preferably, during the first 100 $m^3$ and the last 100 $m^3$ of the fourth stage, the bio-oil displacement agent is injected at a rate of 0.5% while the sand-carrying liquid is injected.

After completing the temporary plugging and diverting, continue to use the large liquid volume and multi-step sand ratio alternate fracturing mode to continue to propagate the fractures after the turning, and realize the support of the fractures and fractures, and finally form a complex network of volumetric fractures. Larger reservoir reconstruction volume, while expanding the bio-displacement agent to all fractures, effectively reducing oil-water surface tension and crude oil viscosity, and has a good cleaning effect on oil sands. In the process of boring wells, HE-BIO Biological oil displacement agents can generate carbon dioxide in situ in the oil reservoir to further improve the oil displacement effect.

Figure 3:
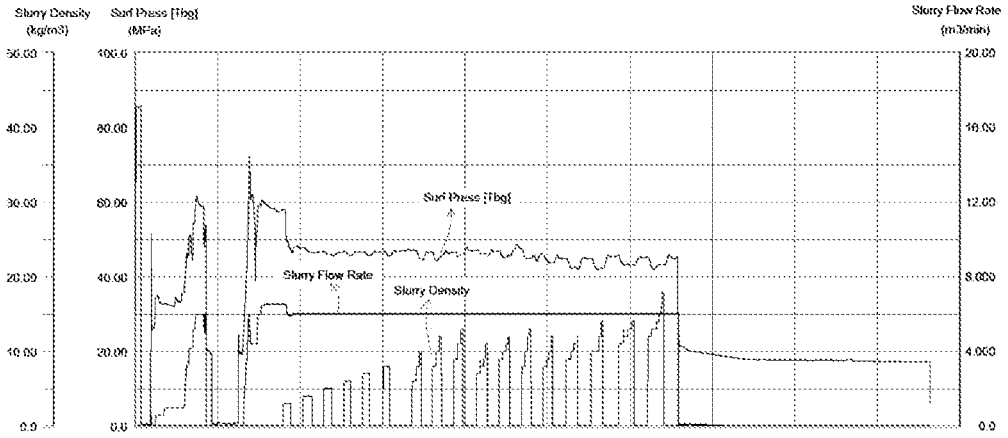
FIG. 3 is a diagram of fracturing operation and borehole pressure curve of a preferred embodiment of a preferred embodiment of volumetric fracturing method of temporarily plugging and diverting through functional slick water with oil displacement agent injected simultaneously.

Completed the fracturing construction of the implementation well according to the pumping and injection construction procedures, and the construction was smooth; the injection of clearing acid before fracturing can achieve the purpose of dredging the blasthole and connecting the formation, reducing the construction friction and ensuring the normal progress of subsequent construction; By injecting low-viscosity slick water fracturing fluid with high flow rate, multi-fractures and multi-network fractures are formed, which increases the reconstruction volume, and uses different particle size proppants to achieve effective filling of multi-stage fractures. The post-compression G-function analysis shows (in FIG. 3) that the goal of fracture complication is achieved. The net pressure is 11.81 MPa, which is beneficial to overcome the horizontal two-way stress difference and realize the crack turning. The fitted reservoir pressure increased by 5.07 MPa compared with the original pressure, indicating that the large liquid injection played a role in energy storage. Even though the wellhead pressure drops to zero during flowback after pressure, liquid can still be discharged, indicating that the liquid supply capacity has been greatly improved.

In summary, the beneficial effects of this disclosure are as follows:

(1) by injecting oil displacement agent to reservoir, the temporary plugging diverting fracturing is integrated with enhanced oil recovery, which not only improves the injection depth and breadth of biological oil displacement agent, communicates remaining oil areas, and realizes the effect of enhanced oil recovery and improves the single well production, as well as reduces the construction risk of diverting fracturing, reduces construction investment, and improves construction efficiency. At the same time, it can overcome the incomplete removal of temporary plugging agent and the water lock effect of fracturing fluid caused by diverting fracturing.

(2) through the integrated effect of large liquid volume, high flow rate, low sand ratio, intermittent columnar multi-step sanding process and the injected biological oil displacement agent, it not only compensates for the pressure and fluid deficit caused by production, but also supplements the formation energy of the low-pressure layer, and the liquid breaks down and contacts the new reservoir, which effectively increases the contact area with the reservoir and the reforming volume of the reservoir, and reduces the oil-water interfacial tension, achieving the purpose of increasing production by temporary plugging and diverting volumetric fracturing.

It is to be understood, however, that even though numerous characteristics and advantages of this disclosure have been set forth in the foregoing description, the disclosure is illustrative only, and changes may be made in detail, especially in matters of shape, size, and arrangement of parts within the principles of this disclosure to the full extent indicated by the broad general meaning of the terms in which the appended claims are expressed.

What is claimed is:

1. A volumetric fracturing method of temporarily plugging and diverting through functional slick water with oil displacement agent injected simultaneously includes the following steps:

S1 obtaining a plurality of reservoir parameters of Ma a target interval of an implementation well to determine the target interval for temporary plugging and steering fracturing, fracturing parameters, and pumping and injection construction procedures, wherein the fracturing parameters include at least flow rate, and the flow rate is not less than 6 $m^3$/min;

S2 in accordance with the pumping and injection construction procedures, pumping prefluid and sand-carrying fluid into the target interval, and at the same time, injecting biological oil displacement agent into the target interval in sequence;

S3 pumping temporary plugging agent into the target interval according to the pumping and injection construction procedures to implement crack plugging diverting;

S4 pumping the sand-carrying liquid into the target interval in accordance with the pumping and injection construction procedures, and at the same time injecting the biological oil displacement agent into the target interval, wherein the sand ratio of the sand-carrying liquid is not more than 15%;

S5 pumping displacement fluid into the target interval in accordance with the pumping and injection construction procedures to complete the fracturing construction.

2. The volumetric fracturing method of temporarily plugging and diverting through functional slick water with oil displacement agent injected simultaneously according to claim 1, wherein the prefluid is slick water fracturing fluid, and the slick water fracturing fluid is used to create fractures and slug the reservoir in the initial stage of fracturing, the sand carrying fluid is slick water fracturing fluid containing proppants, the displacement fluid is slick water fracturing fluid that does not contain proppants.

3. The volumetric fracturing method of temporarily plugging and diverting through functional slick water with oil displacement agent injected simultaneously according to claim 2, wherein the viscosity of the slick water fracturing fluid is 1.0-3.0 mPa·s.

4. The volumetric fracturing method of temporarily plugging and diverting through functional slick water with oil displacement agent injected simultaneously according to claim 1, wherein the temporary plugging agent is MP-1 type water-soluble temporary plugging agent for fracturing.

5. The volumetric fracturing method of temporarily plugging and diverting through functional slick water with oil displacement agent injected simultaneously according to claim 1, wherein after the step 5, it also includes the following steps: S6 closing the implementation well.

6. The volumetric fracturing method of temporarily plugging and diverting through functional slick water with oil displacement agent injected simultaneously according to claim 5, wherein a boreholes closing time lasts for 15-20 days.

7. The volumetric fracturing method of temporarily plugging and diverting through functional slick water with oil displacement agent injected simultaneously according to claim 1, in the step S2, the injection volume of the prefluid accounts for 30% to 50% of the total injection volume of the fracturing fluid.

8. The volumetric fracturing method of temporarily plugging and diverting through functional slick water with oil displacement agent injected simultaneously according to claim 1, wherein the step S2 includes the following steps:

injecting the prefluid into the target interval, after injecting 150-180 $m^3$ prefluid, beginning to alternately add 40/70 mesh quartz sand to slug, the sand ratio starts from 2% and increases by 1% sequentially to 7%;

alternately injecting the sand-carrying liquid into the target interval, the sand ratio of the sand-carrying liquid is increased in three steps in multiple injections, among which the quartz sand is 40/70 mesh;

alternately injecting the sand-carrying liquid into the target interval, the sand ratio of the sand-carrying liquid is increased in four steps in multiple injections, among which the quartz sand is 20/40 mesh.

9. The volumetric fracturing method of temporarily plugging and diverting through functional slick water with oil displacement agent injected simultaneously according to claim 8, wherein the 40/70 mesh quartz sand is injected into the sand-carrying liquid for three times, in which the sand ratio of the sand-carrying liquid injected for the first time is increased in three steps of 6%-7%-8%; the sand ratio of the sand-carrying liquid increases in three steps of 7%-8%-9%; the sand ratio of the sand-carrying liquid injected for the third time increases in three steps of 8%-9%-10%.

10. The volumetric fracturing method of temporarily plugging and diverting through functional slick water with oil displacement agent injected simultaneously according to claim 8, wherein the 20/40 mesh quartz sand is injected into the sand-carrying liquid for three times, wherein the sand ratio of the sand-carrying liquid injected for the first time is increased in four steps of 6%-7%-8%-9%; the sand ratio of the sand-carrying liquid injected for the second time is increased in four steps of 7%-8%-9%-10%; the sand ratio of the sand-carrying liquid injected for the third time is increased in four steps of 8%-9%-10%-11%.

* * * * *